US005860829A

United States Patent [19]

Hower et al.

[11] Patent Number: 5,860,829

[45] Date of Patent: Jan. 19, 1999

[54] CROSS CONNECT TERMINAL BLOCK

[75] Inventors: James Shannon Hower, Harrisburg; Maris Anthony Glass, York, both of Pa.

[73] Assignee: The Whitaker Corporation, Wilmington, Del.

[21] Appl. No.: 713,888

[22] Filed: Sep. 17, 1996

Related U.S. Application Data

[63] Continuation-in-part of Ser. No. 656,113, May 31, 1996, abandoned.

[51] Int. Cl.[6] ..... H01R 4/26

[52] U.S. Cl. ..... 439/417; 439/397; 439/402; 439/711

[58] Field of Search ..... 439/395–413, 439/417, 709–715, 718, 722–729

[56] References Cited

U.S. PATENT DOCUMENTS

| | | | |
|---|---|---|---|
| 4,593,965 | 6/1986 | Joly | 439/398 |
| 5,006,077 | 4/1991 | Loose et al. | 439/409 |
| 5,219,302 | 6/1993 | Robertson et al. | 439/404 |
| 5,317,474 | 5/1994 | Capper et al. | 361/119 |
| 5,321,577 | 6/1994 | Capper et al. | 361/119 |
| 5,423,694 | 6/1995 | Jensen et al. | 439/417 |
| 5,504,654 | 4/1996 | Knox et al. | 361/119 |
| 5,588,869 | 12/1996 | Jensen et al. | 439/417 |
| 5,669,778 | 9/1997 | Krämer et al. | 439/398 |

*Primary Examiner*—Neil Abrams
*Assistant Examiner*—Brian J. Biggi
*Attorney, Agent, or Firm*—Salvatore Anastasi

[57] ABSTRACT

The invention comprises an interconnection system having an assembly with a base member and a silo. The silo has an upper contact receiving passageway and a lower contact receiving passageway. The silo is slidably mounted onto the base and reciprocally movable in a linear manner between an unterminated position and a terminated position. A pair of U-shaped terminals securable in the base to be received within the silo upon assembly of the silo to the base. Each of the terminals include a base section and a pair of legs extending normally therefrom to define the U-shape. The legs include aligned wire receiving openings and aligned IDC termination slots extending from the openings. A third IDC termination slot is formed along a top of the terminal. The bottom passageway of the silo is aligned with the wire receiving openings and the upper passageway is above the third IDC termination slot when the silo is in the unterminated position. The bottom passageway of the silo is aligned with the aligned IDC termination slots and the upper passageway is aligned with the third IDC termination slot when the silo is in the terminated position.

49 Claims, 12 Drawing Sheets

CROSS CONNECT TERMINAL BLOCK

This is a Continuation-In Part of U.S. patent application Ser. No. 08/656,113, filed May 31, 1996 now abandoned.

FIELD OF THE INVENTION

The present invention relates to the field of electrical connectors and more particularly, to connectors for connecting pairs of signal wires together.

BACKGROUND OF THE INVENTION

In the telecommunications industry, telephone cable is introduced to individual telephone sites such as residences mainly through use of splice of the signal wires of the cable to respective house wires at a junction located outside or inside the house. Ends of the house cable and the drop cable from the transmission line enter an enclosure; each of a pair of signal wires of each cable is prepared to be spliced to its respective counterpart in the other cable; and the prepared wire ends are then placed within the terminal which is manipulated to penetrate the insulation of both wires to engage the conductors and thus interconnect them. Terminal blocks also provide dielectric protective structure around the splice and together with the enclosure provide protection from the environment especially from water, dust and other contaminants and also from insects and animals.

One type of terminal block for interconnecting a pair of wires is disclosed in U.S. Pat. No. 5,006,077. A tubular dielectric housing has a center post therein defining an annular cavity. A stationary tubular terminal and a rotatable tubular terminal are disposed within the cavity in electrical engagement with each other. A tubular actuator is also mounted in the housing and is adapted to be rotated between actuated and unactuated positions to rotate the rotatable terminal. A pair of wire receiving apertures extend through the annular cavity and both of the tubular terminals. Upon rotation of the rotatable terminal by the actuator, slot walls of the terminal pierce the wire insulation and engage conductor within the wires. The stationary terminal includes a contact section extending outwardly from the housing including insulation displacement slots for a wire to be inserted thereinto and terminated.

U.S. Pat. No. 5,219,302 discloses a terminal block module which includes two terminal blocks. The terminal blocks are defined by a tubular housing section having an annular cavity and a tubular one piece terminal secured within the annular cavity. Each terminal block includes a pair of wire receiving apertures into which wire ends are inserted to extend through insulation piercing slots of the terminal and upon rotation, the slots pierce the insulation of the wire and engage the conductor of each wire thus interconnecting them.

What is needed is a terminal block enabling simplified and assured wire termination and untermination to cross connect the two wires. It is further needed to provide for overvoltage surge protection in the terminal box. It is also needed to provide a higher density terminal block.

SUMMARY OF THE INVENTION

The invention comprises an interconnection system having an assembly with a base member and a silo. The silo has an upper contact receiving passageway and a lower contact receiving passageway. The silo is slidably mounted onto the base and reciprocally movable in a linear manner between an unterminated position and a terminated position. A pair of U-shaped terminals securable in the base to be received within the silo upon assembly of the silo to the base. Each of the terminals include a base section and a pair of legs extending normally therefrom to define the U-shape. The legs include aligned wire receiving openings and aligned IDC termination slots extending from the openings. A third IDC termination slot is formed along a top of the terminal. The bottom passageway of the silo is aligned with the wire receiving openings and the upper passageway is above the third IDC termination slot when the silo is in the unterminated position. The bottom passageway of the silo is aligned with the aligned IDC termination slots and the upper passageway is aligned with the third IDC termination slot when the silo is in the terminated position.

BRIEF DESCRIPTION OF THE DRAWINGS

Embodiments of the invention will now be described with reference to the accompanying drawings, in which.

DETAILED DESCRIPTION OF THE INVENTION

Figure 1:
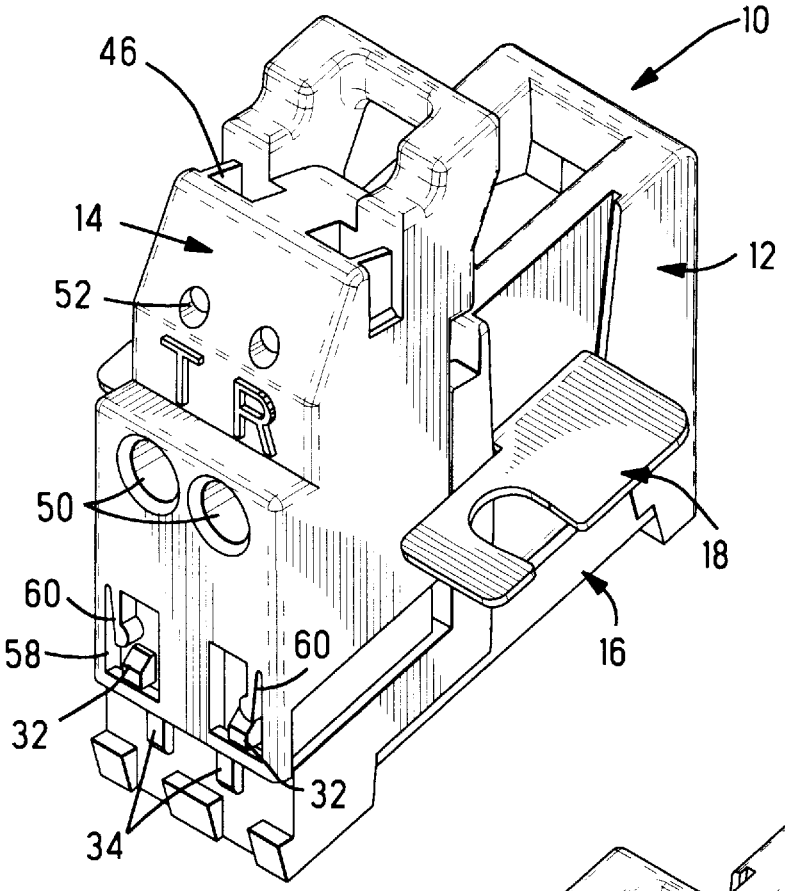
FIG. 1 is a perspective view of the terminal block of the present invention in which the housing is in the unterminated position.

This invention is directed to an interconnection system, such as for a distribution system for telephones, that it designed for easy field termination or untermination. The interconnection system comprises a terminal block assembly 10 which includes a base 12 and a silo 14. The base has a bottom cover 16 and further includes a ground contact 18. The assembly also includes a pair of IDC terminals 20 as is shown in FIG. 8 and optionally an overvoltage protector 22.

Figure 8:
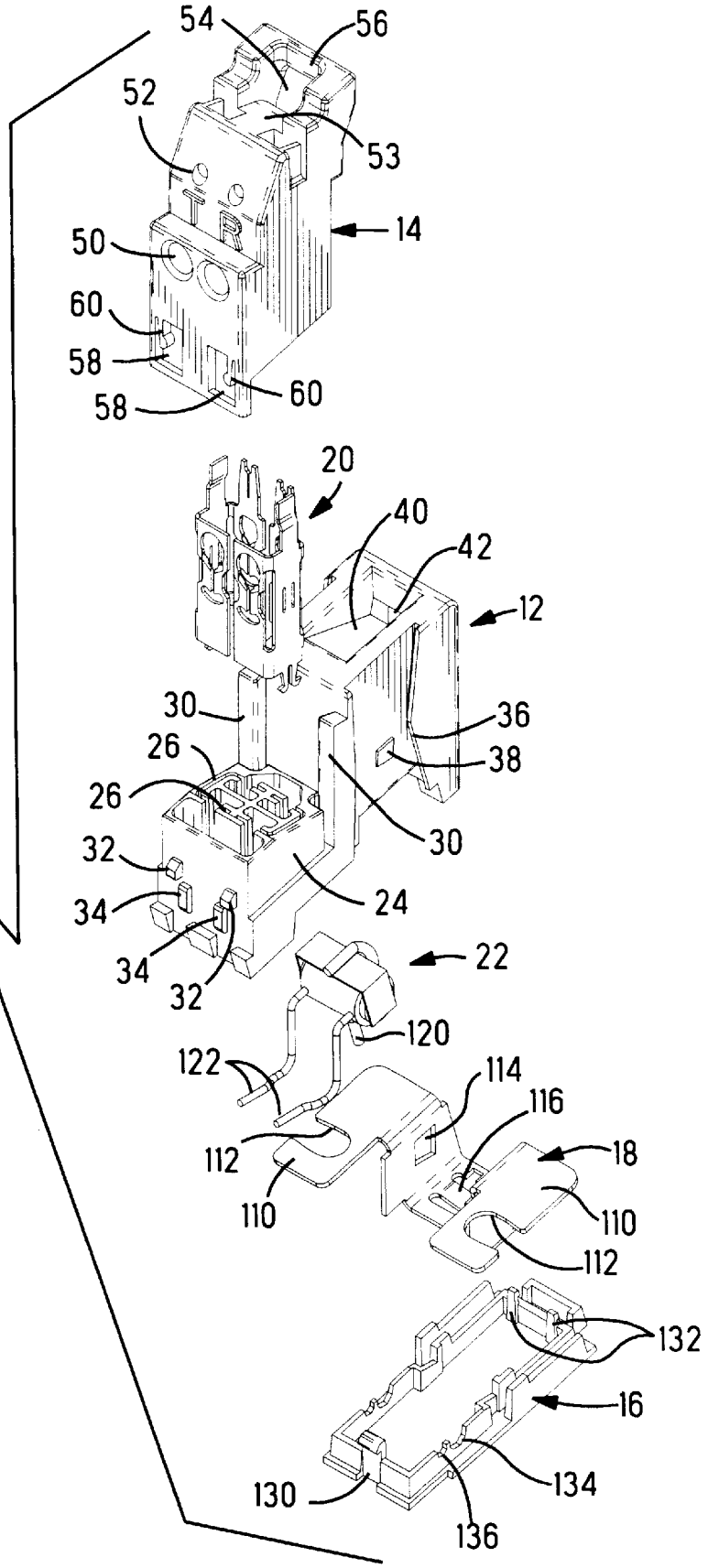
FIG. 8 is an exploded isometric view of the terminal block assembly having surge protection therein.

As is seen in FIG. 8, the base 12 includes an upstanding pedestal 24 for slidably receiving respective silo 14. Each pedestal 24 has a series of slots 26 for receiving a corresponding one of the pairs of terminals 20. The terminals 20 are in a spaced apart relationship within the base 12 and the silo 14. The base 12 also includes a pair of guide ribs 30 for guiding the silo 14 from the terminated to the unterminated position. Along the front wall of the base 12 are latching protrusions 32,34. The latching protrusions cooperate with the silo 14 to keep the silo secured to the base in both the terminated and unterminated position as will be described more fully hereinafter. There are similar slots and embossments along the opposite side of the ground contact which are not shown. Along the rear portion of the base 12 are slots 36 with a latching embossment 38 to receive the ground contact 18 therein and secure the ground contact to the base 12. Along the top portion of the base 12 is a ramp surface 40. At the rear of the ramp surface is an opening 42 which can be used in cooperation with a tool to terminate and unterminate the silo 14 as will be described more fully hereinafter.

The silo 14 will now be described in relation to both FIG. 1 and FIG. 8. The silos will be used to interconnect the tip line from the service line with the tip line of the customer line and the silo will also interconnect the ring lines from the service and customer lines. The silo includes two pairs of conductor receiving passages 50 and 52. These conductor receiving passages 50,52 will receive the tip and ring lines, each in the respective silos, which are to be interconnected by the terminal block assembly. The service wire will be received within the larger conductor receiving opening 50. The customer wire will be received within the smaller and upper conductor receiving passageway 52, therefore when the assembly is in the terminated position, the customer tip and ring lines will be interconnected to the corresponding service lines.

Along the top of the silo is an opening 54 along with an actuation bar 56 and a ramped surface 53. The actuation bar and the ramped surface will be used in conjunction with the opening 42 on the base 12 to terminate and unterminate the assembly.

Figure 2:
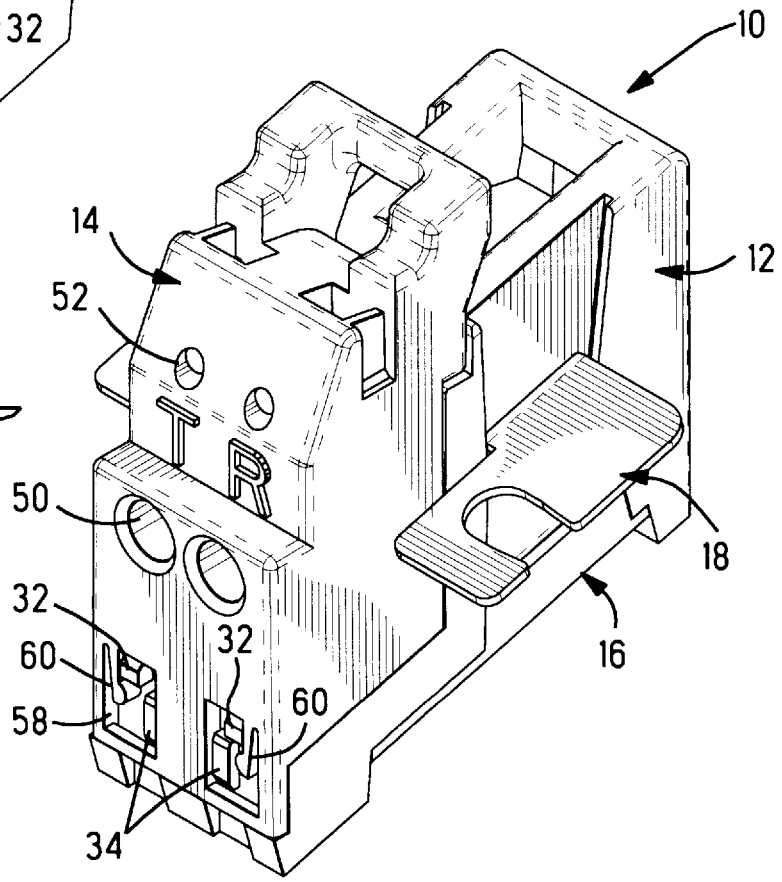
FIG. 2 is a similar to FIG. 1 but the housing is in the terminated position.
Figure 3:
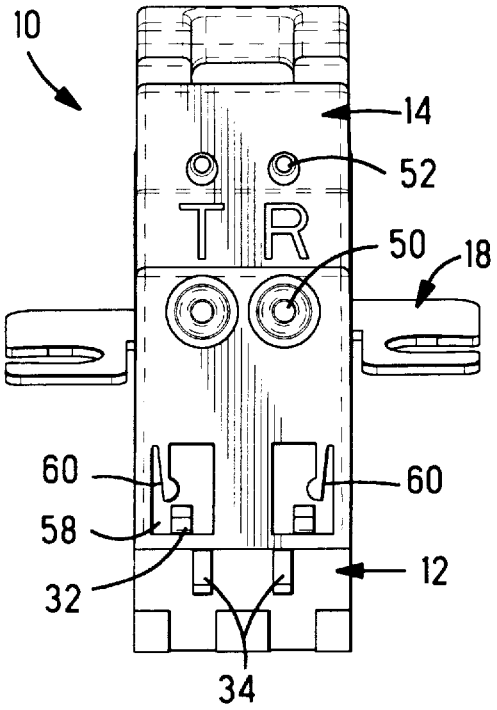
FIG. 3 is a front view of the terminal block with the housing in the unterminated position.
Figure 4:
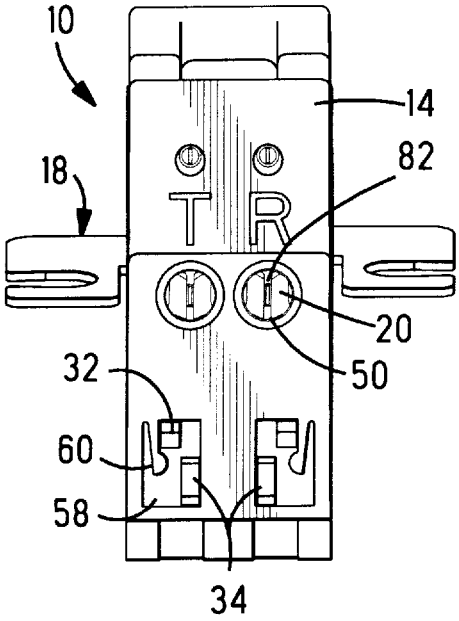
FIG. 4 is a front view of the terminal block with the housing in the terminated position.

Along the front face of the silo 14 are openings 58. Each of the openings 58 have a resilient latching finger 60. When the silo is in the terminated position as is shown in FIG. 2, both of the latching protrusions 32,34 reside within the opening 58 on the silo 14. The resilient finger 60 engages the bottom of the latching protrusion 32 and the latching protrusion 34 engages the bottom of the opening thereby keeping the silo secured in the terminated position. When the silo is moved to the unterminated position as is shown in FIG. 1, the bottom of the opening will snap up and over the top of protrusion 34 and the bottom of the silo will come to rest on the top of the protrusion 34. Further, the resilient fingers 60 will be pushed above the latching protrusions 32. Therefore, the combination of the protrusion 32 acting on the bottom of the opening 58 and the bottom of the silo resting on top of the protrusion 34 will keep the silo secured within the unterminated position on the base 12. When the silo is pushed into the terminated position, the order is reversed and the bottom of the silo is pushed past the protrusion 34 the resilient finger will be pushed around the protrusion 32 thereby securing the silo once again in the terminated position. This combination allows the silo to be secured onto the base in the two different positions, however, still allowing the operator to move the silo 14 from the unterminated position to the terminated position thereby interconnecting and disconnecting the customer and service lines. The interaction of the openings 58 and the resilient finger 60 along with the latching protrusions 32 and 34 is shown in more detail in FIG. 3 and 4.

Figure 5:
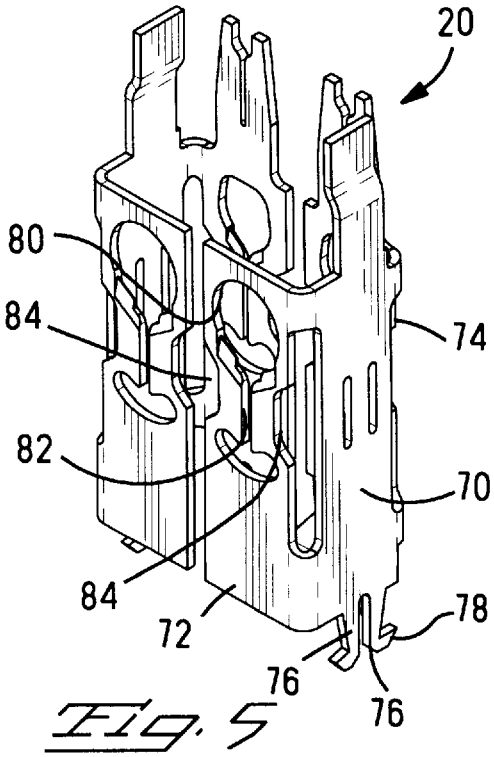
FIG. 5 is an isometric view showing the front portion of the contact.
Figure 6:
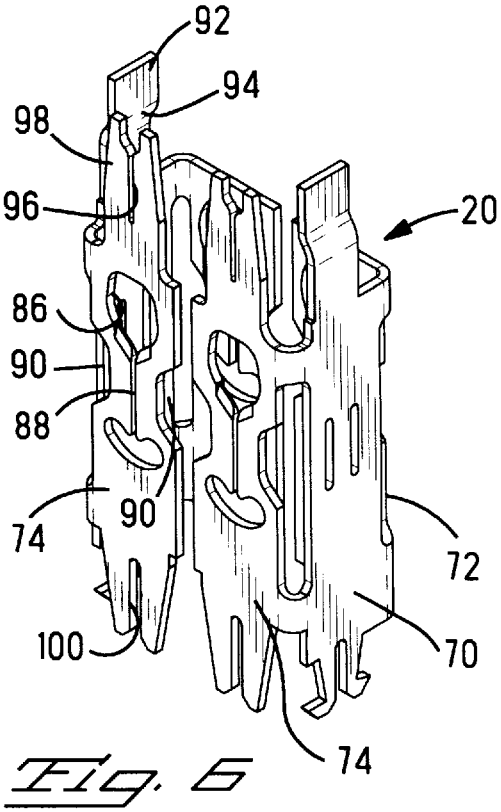
FIG. 6 is an isometric view showing the rear portion of the contact.

The details of the IDC terminal 20 will now be described with reference to FIGS. 5 and 6. Each silo 14 houses two terminals in a spaced apart relationship similar to that shown in FIG. 5 and 6. The IDC terminal includes a base leg 70 with a front leg 72 and a rear leg 74 extending therefrom. Extending from the bottom of the base 70 are latching arms 76. The latching arms each include a protrusion 78 on their end which are used to secure the IDC terminal 20 within the base 12. The front leg 72 includes a wire receiving opening 80 and an IDC slot 82 adjacent to the wire receiving opening. When the wire is received through the wire receiving opening 80 it is then pushed down in between the arms of the IDC slot 82. On either side of the IDC slot are relief openings 84 which allow the IDC slot to flex and deform the wire during termination. Along the rear legs of the IDC terminal 20 is another wire receiving opening 86. Also an analogous IDC slot 88 along with relief openings 90 are also disposed along the rear legs 74. The IDC slot 88 along the rear leg 74 is smaller than the IDC slot 82 along the front leg 72 to provide electrical connection for smaller wires received within the terminal assembly.

Along the top of each of the IDC terminals 20 is an extension 92 having a bent portion 94. The extension 92 extends above the IDC terminal to provide a means of testing in the field as is known in the art. Also extending upwardly from the rear legs 74 is a third IDC slot 96 which is positioned between legs 98. Extending from the bottom of the rear legs 74 is a fourth IDC slot 100 which is used for connecting either overvoltage protection or bridging contacts to the terminal depending on the needs of the user.

Figure 7:
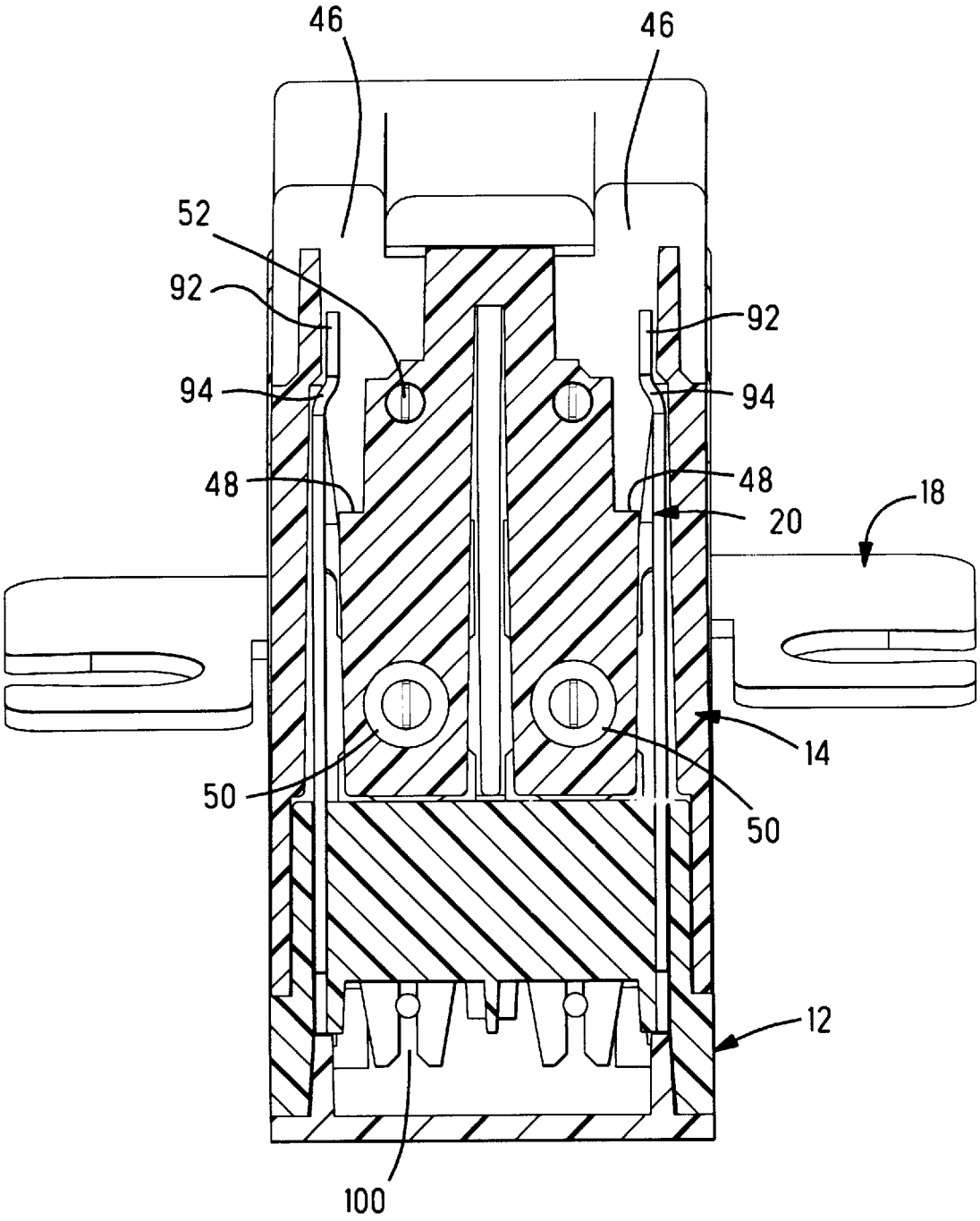
FIG. 7 is a cross sectional view showing the housing in the terminated position.

FIG. 7 shows a cross sectional view of the terminal 20 mounted within the silo 14. The extension 92 on the terminal extend into opening 46, see also FIG. 1, which is disposed along the top of the silo 14. The extension 92 is accessible from the top of the silo so that a technician can test the connection by attaching alligator clips to the extension 92 as is known in the art. The bend 94 on the terminal 20 serves the additional purpose of resistance against the silo 14 from being removed from the base. When the silo 14 is pushed upward to the unterminated position, internal shoulders 48 on the silo 14 will engage the bend 94 and resists the silo 14 from being removed from the base.

Figure 10:
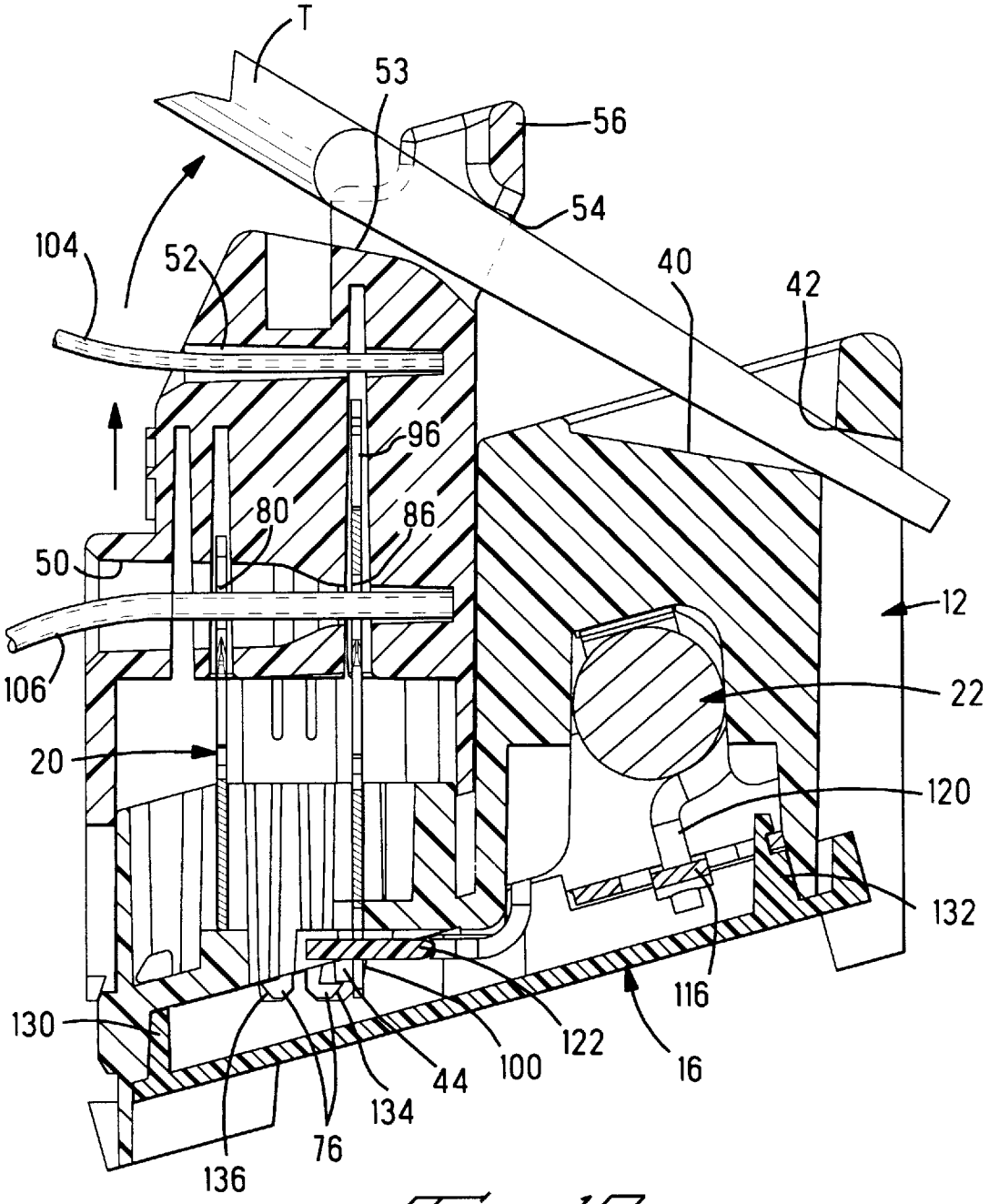
FIG. 10 is a cross sectional view showing the housing in the unterminated position.

The ground contact 18 has mounting tabs 110 along with a mounting slot 112 to secure the grounding contact to external ground when the assembly is secured within an enclosure, as is shown in FIG. 8. The ground contact also has latching recesses 114 which when assembled with the base will engage the latching embossment 38 on the side of the base 12. Further along the base of the ground contact 18 is sliding interface slot 116 which is also shown in FIG. 10 to receive the grounding terminal from the overvoltage protector 22.

The overvoltage protector 22 has a grounding terminal 120 and two signal terminals 122. The signal terminals will be electrically connected to the IDC slot 100 on the respective terminals 20.

Finally, a cover 16 is received on the bottom of base 12 to protect the base from outside debris and moisture. The cover 16 has a forward latching arm 130 and rear latching arms 132 which are used to secure the cover to the base 12 and are shown more fully in FIG. 10. The cover also has two recesses 134 and 136 along each side of the cover. The recesses are designed to receive the bottom portion of the latching arms 76 on the terminal 20 to secure the terminal within the base.

Figure 9:
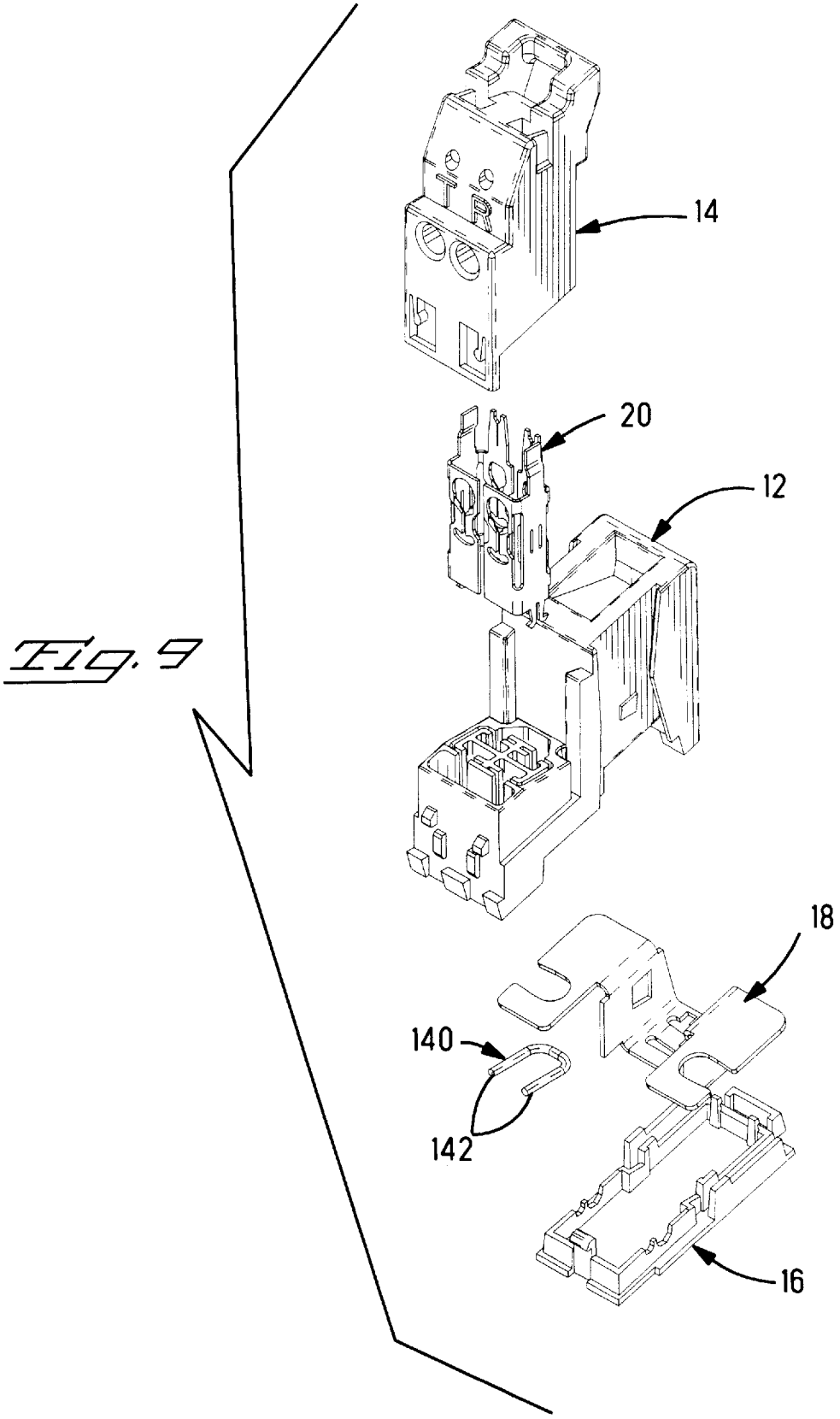
FIG. 9 is an exploded perspective view of an alternative embodiment of the terminal block assembly wherein the terminals are bridged.

FIG. 9 shows an alternative embodiment of the present invention in which the assembly has a bridging contact 140 rather than the overvoltage protection. The bridging contact 140 has two arms 142 which are received into the IDC slots 100 on the adjacent pairs of terminal 20 thereby commoning the adjacent terminals to each other. The remainder of the assembly is substantially the same as the embodiment shown in FIG. 8.

FIG. 10 shows a cross sectional view of the terminal block assembly 10 fully assembled. The assembly shown in FIG. 10 is in the unterminated position wherein the silo is in the upper position for insertion of the customer wire 104 and the service wire 106. As can be seen in the cross sectional view, the cover is secured to the bottom of the base 12 wherein the latching arm 130 and 132 are secured to the bottom of the base to secure the cover thereto. Further, the overvoltage protection is secured to the ground contact 18 by having the ground lead 120 within the sliding interface slot 116. The signal leads 122 of the overvoltage protector are secured within the IDC slot 100 of the terminal 20. Also it can be seen that the latching arms 76 are received within the recesses 134, 136 of the cover. The latching arms also engage a portion 44 of the base 12 thereby securing the contact terminal 20 within the base 12.

The conductor receiving passageway 50 has a forward, larger portion which is necked down into a rearward, narrower portion. If a large wire 106 is received within the conductor receiving passageway 50, it will only be received in the wider large portion engaging the neck down portion to prevent it from being inserted further. However, if a smaller conductor receiving wire 106, as is shown in FIG. 10, is received within the conductor receiving passageway 50, it can be passed all the way through into the narrower portion of the connector receiving passageway.

Figure 11:
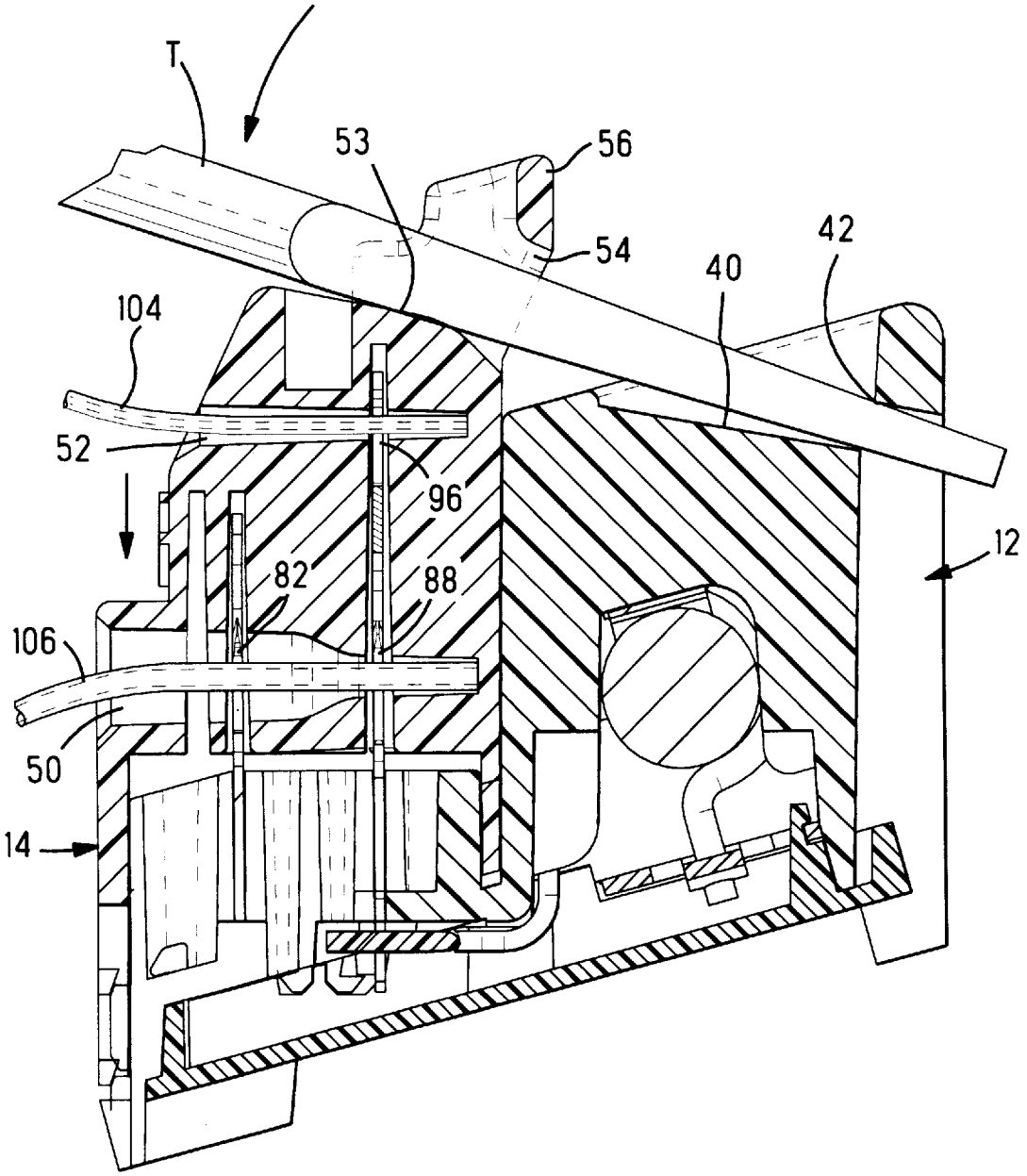
FIG. 11 is a cross sectional view showing the housing in the terminated position.

When the silo 14 is in the unterminated position, the conductor receiving passageway 50 is aligned with the wire receiving openings 80 and 86 and the conductor receiving passageway 52 is above the IDC slot 96 thereby allowing the wires to be freely inserted into the conductor receiving passageways. The silo is then moved into the terminated position as is shown in FIG. 11 by rotating the tool T downwardly engaging the ramp surface 53 on the top of the silo 14 and in conjunction with the opening 42, pushes the silo down into the terminated position. In this position, the conductor receiving passageway 52 is now aligned with the IDC slot 96. Further, the conductor receiving passageway 50 is aligned with the IDC slots 82 and 88.

When the silo is pushed into the terminated position, the wire 104 is pushed down into the IDC slot 96 thereby terminating the wire 104 to the terminal 20. Further, the wire 106 is pushed down into the IDC slot 82 or 88 also terminating the wire 106 to the terminal and thereby cross connecting the wires 104 and 106 to each other. In the event that the wire 106 is larger and is only received in the forward portion of the connector receiving passageway 50, the wire will then only be terminated to the larger IDC slot 82. However, when a smaller wire is inserted, it will engage the smaller IDC slot 88 on the terminal 20 thereby ensuring good electrical engagement with the conductor whether the wire is large or small.

The wires 104, 106 will be terminated to the terminal 20 in a staggered manner. During termination, wire 106 will be pushed into the IDC slot 82 or 88, then wire 104 will be pushed into the IDC slot 96. The staggered engagement requires a lower force for termination than would be required if all of the wires were terminated at the same time.

To unterminate the silo, it is only necessary to take the tool and push the silo up as is shown earlier in FIG. 10. The tool will cooperate with the opening 42 on the base along with the actuation bar 56 to move the silo in a linearly upwardly motion thereby pulling the wires out of the IDC slots for removal and or replacement of the wires.

Figure 12:
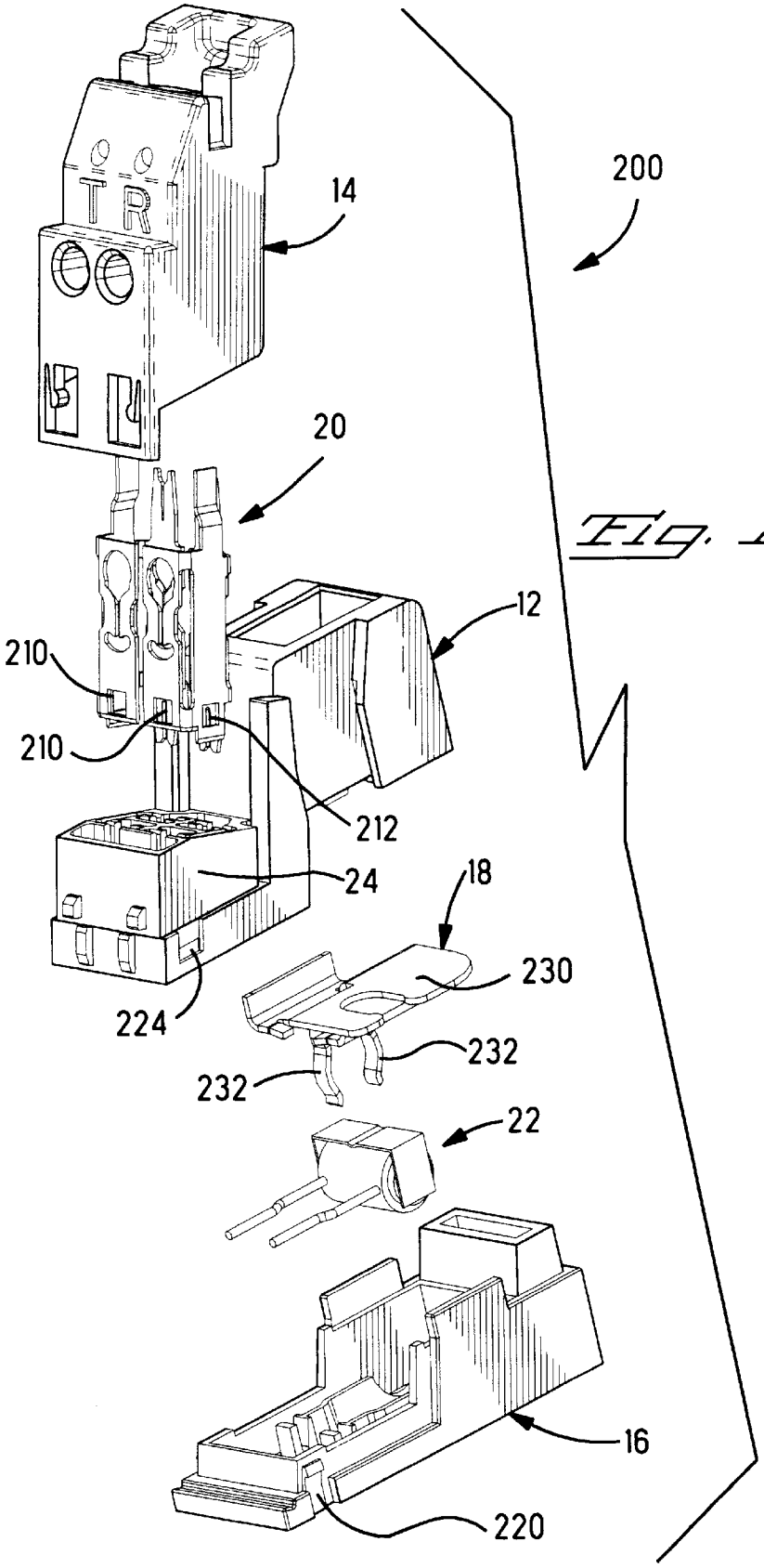
FIG. 12 is an exploded isometric view of an alternative embodiment of the terminal block assembly.
Figure 15:
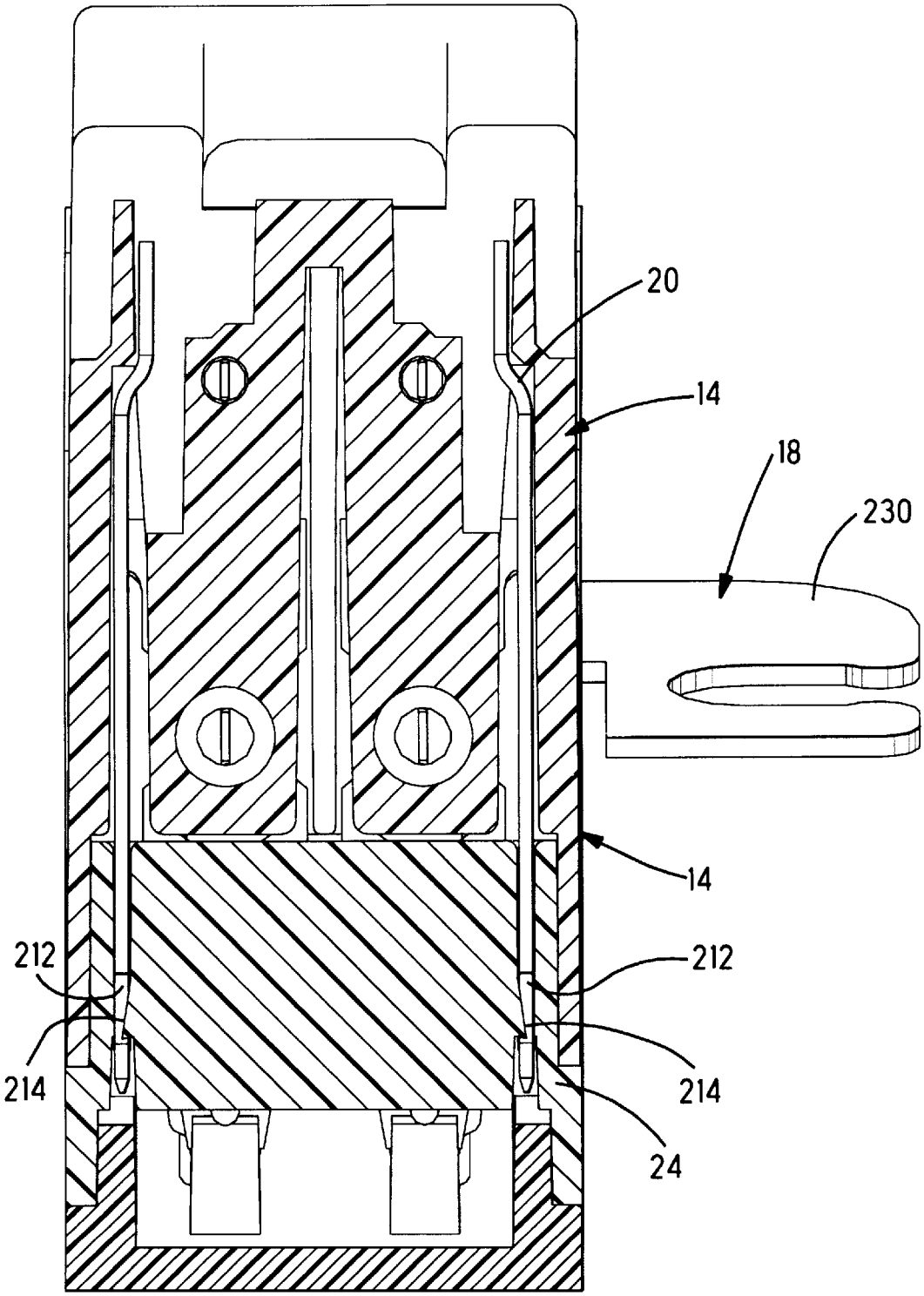
FIG. 15 is a cross sectional view of the terminal block assembly.
Figure 16:
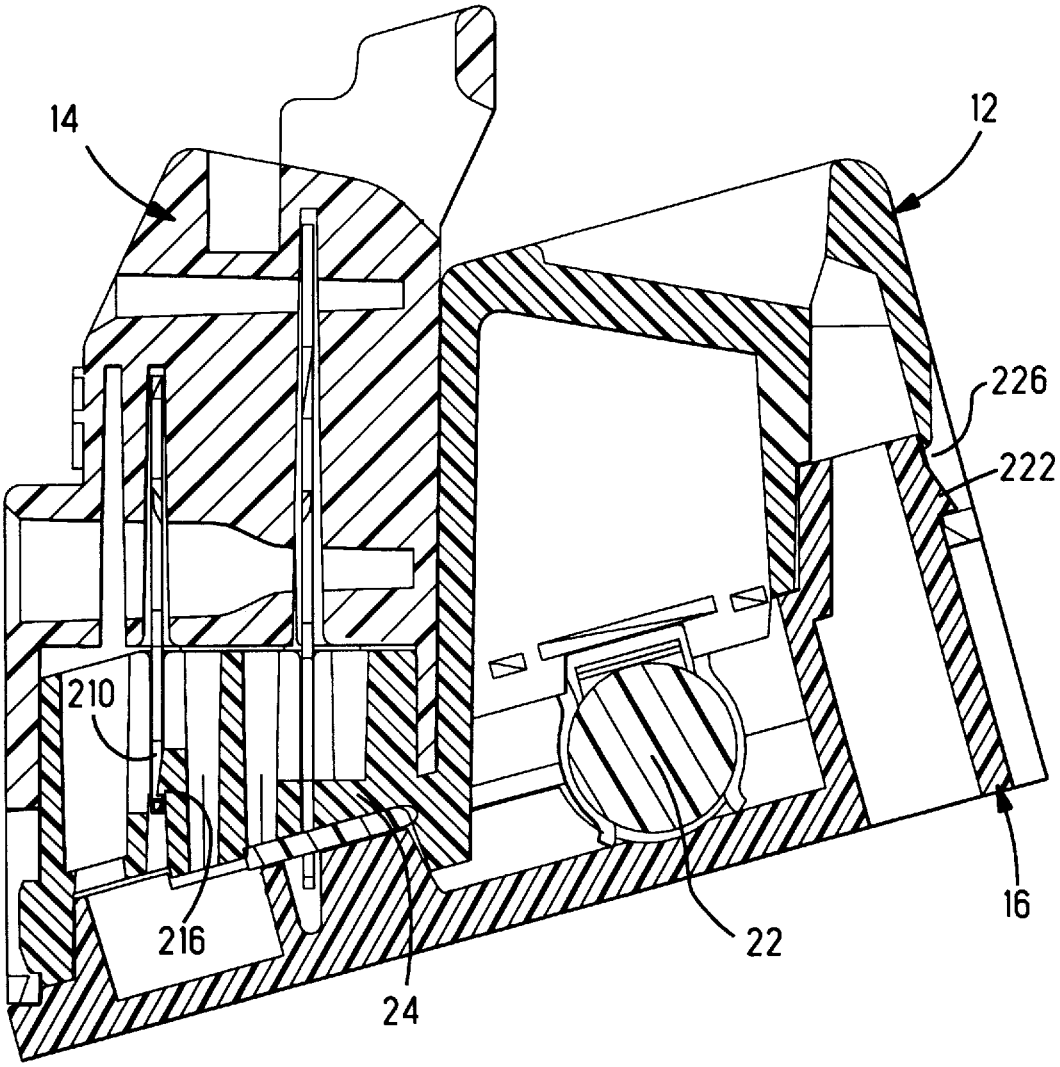
FIG. 16 is a cross sectional view of the assembled terminal block assembly.

FIG. 12 shows an exploded view of an alternative embodiment of the terminal block assembly in which like features will have like numerals as described earlier. The terminal block assembly 200 includes a base 12 a silo 14, and a cover 16. The assembly includes two terminals 20. The terminal block assembly 200 works substantially the same as the earlier embodiment therefore only the differences will be described. Each of the terminals 20 have windows 210, 212, the windows being square openings extending through the terminal. The windows 210 being disposed along the front face of the IDC terminal 20 and the windows 212 being disclosed along the side face of the terminal 20. The windows 210, 212 are used to secure the terminal 20 to the pedestal 24 of the base 12. As can be seen in FIG. 15 the pedestal 24 has locking ledges 214 disposed therein. When the terminals 20 are inserted into the pedestal 24 the locking ledges 214 are received within the windows 212 thereby securing the terminals 20 to the base 12. As can been see in FIG. 16 pedestal 24 also has locking ledge 216. When the terminal 20 is inserted into the pedestal 24 the locking ledge 216 is received within window 210 thereby further securing the terminal 20 to the base 12. The cooperation of the locking ledges with the windows on the terminal thereby secures the terminals within the pedestal and prevents them from moving during termination and untermination or during movement of the silo 14.

Figure 13:
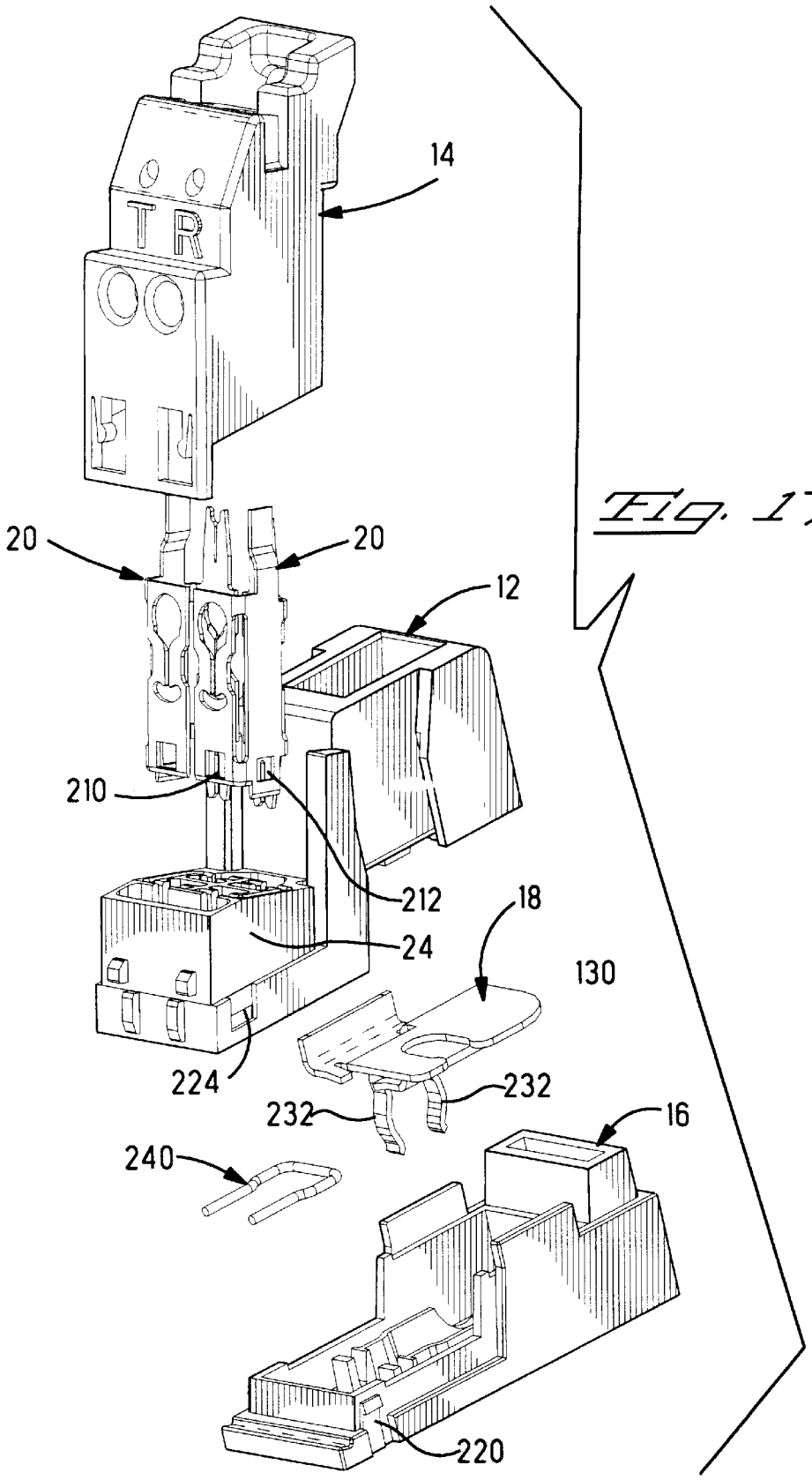
FIG. 13 is an exploded isometric view of an alternative embodiment of the terminal block assembly having a bridging contact.
Figure 14:
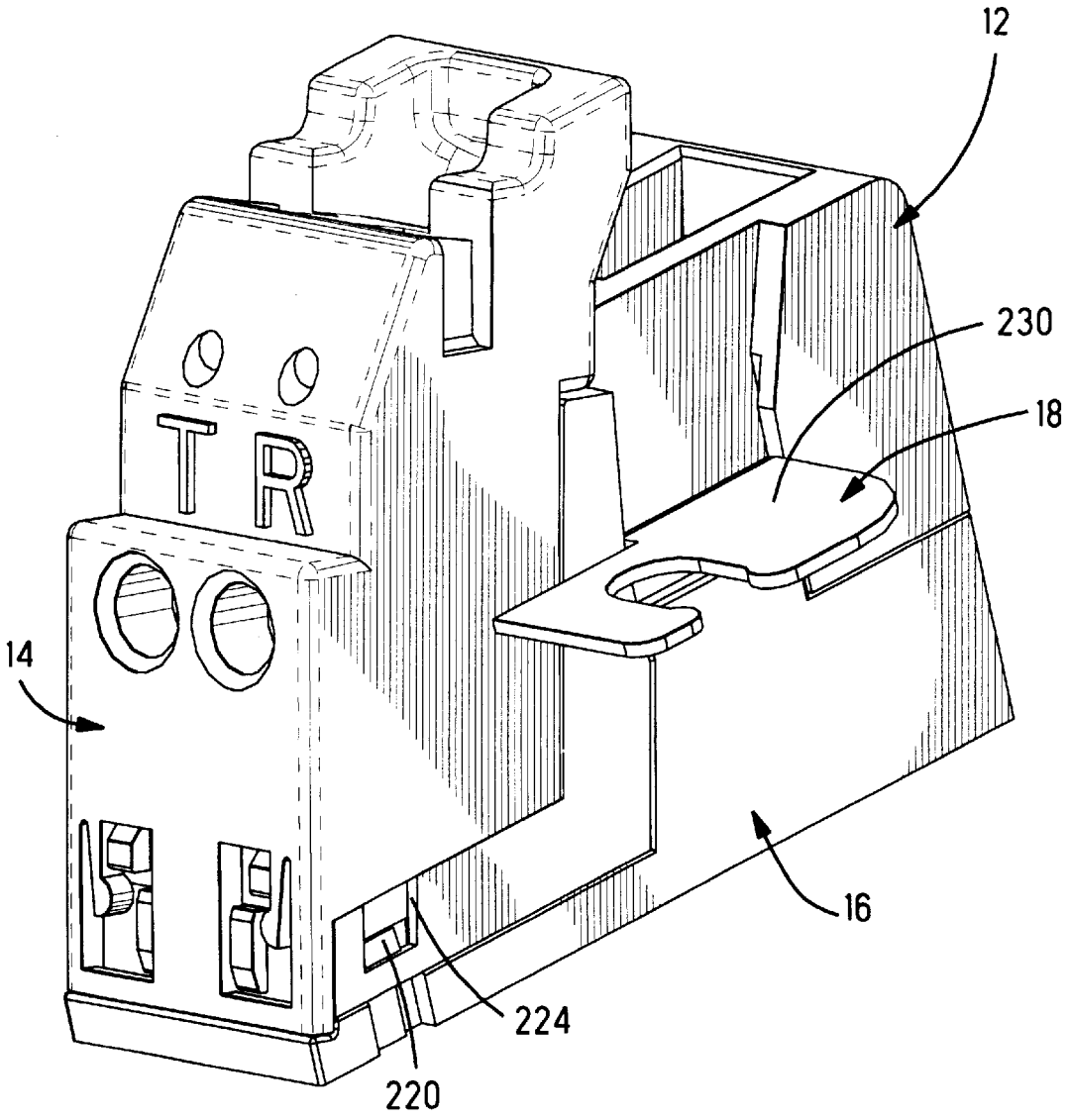
FIG. 14 is an isometric view showing the alternative embodiment assembled.

A further difference in the second embodiment is seen on the cover 16 in FIGS. 12 and 13. The cover 16 has locking fingers 220 which are disposed along the sides of the cover 16, only one of which is shown in FIGS. 12 and 13. Further, the cover has a second locking ledge 222 which is shown more clearly in FIG. 16. When the cover is secured against the bottom of the base 12, locking finger 220 is received into locking recess 224 disposed on the side of base 12 thereby securing the cover to the base. Further locking ledge 222 is received within locking window 226 on the rear of the base 12 further securing the cover 16 to the base 12.

Another difference in this embodiment is shown in the ground contact 18 shown in both FIGS. 12 and 13. The ground contact 18 has only one mounting tab 230, as opposed to the two mounting tabs in the earlier embodiment, to secure the grounding contact to external ground when the assembly is secured within an enclosure. Further, the ground contact 18 has contact fingers 232 which extend from the bottom of the ground contact 18. The contact fingers 232 are designed to engage the grounding region of the overvoltage protector. The overvoltage protector 22 shown in FIG. 12 has two leads for connecting with the IDC terminals 20 however, the over voltage protector 22 is secured to ground by engaging the connection fingers 232 on the ground contact, thereby providing over voltage protection for the terminals.

FIG. 13 shows an alternative embodiment whereby the terminals are grounded to each other by a bridging contact 240. The bridging contact will engage the IDC terminals 20 thereby commoning them.

The advantages of this invention are that the assembly provides for an easy termination and untermination of the wires that are to be cross connected whereby it is only necessary for the user to have a simple tool such as a screw driver to terminate or unterminate the silo and thereby terminate and unterminate the wires from each other.

The connector assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An interconnection system, comprising:

an assembly having a base member and a silo, the silo having an upper contact receiving passageway and a lower contact receiving passageway, the silo being slidably mounted onto the base and reciprocally movable in a linear manner between an unterminated position and a terminated position;

a pair of U-shaped terminals, each of the terminals being securable in the base to be received within the silo upon assembly of the silo to the base, each of the terminals including a base section and a pair of legs extending normally therefrom to define the U-shape, the legs including aligned wire receiving openings and aligned IDC termination slots extending from the openings, a third IDC termination slot is formed along a top of each terminal the third slot being defined by a pair of legs extending upwardly from the terminal such that the IDC slot is disposed therebetween;

the lower passageway of the silo being aligned with the wire receiving openings and the upper passageway being above the third IDC termination slot when the silo is in the unterminated position, the lower passageway of the silo being aligned with the aligned IDC termination slots and the upper passageway being aligned with the third IDC termination slot when the silo is in the terminated position.

2. The interconnection system of claim 1, wherein the base member includes a pedestal having a pair of spaced apart retention slots for receiving and securing the terminals therein.

3. The interconnection system of claim 2, wherein the pedestal has latching ledges and the terminals having latching windows, the latching ledges being received within the latch windows to secure the terminals to the base.

4. The interconnection system of claim 1, wherein the terminal has a lower end with a contact section for termination with a surge protector.

5. The interconnection system of claim 1, wherein the terminal has a lower end with a contact section for termination with a bridging contact.

6. The interconnection system of claim 1, wherein the assembly has tool engaging surfaces whereby the application of a tool can effect movement of the silo between the unterminated position and the termination position.

7. The interconnection system of claim 1, wherein the terminal has a split beam latch to secure the terminal within the base, the latch having two latching arms with protrusions on ends thereof, the latching arms engaging a portion of the base to secure the terminal to the base.

8. The interconnection system of claim 1, wherein the assembly has a latching system for securing the silo to the base, the latching system comprising an opening on the silo with a resilient finger therein, the latching system further comprising two latching protrusions on the base, when the silo is in the unterminated position, the upper of the two latching protrusions is received within the opening on the silo thereby securing the silo in the unterminated position, when the silo is in the terminated position, the upper of the two latching protrusions engages the resilient finger and the lower of the two latching protrusions is received within the opening thereby securing the silo in the terminated position.

9. The interconnection system of claim 1, wherein the terminals of each pair are arranged in close proximity to one another within the silo, with respective of the legs of the terminals being planarly aligned and orthogonal to the contact receiving passageways.

10. The interconnection system of claim 9, wherein a wall of the leg, adjacent the insulation displacement slot, includes a pair of windows to allow flexing of the insulation displacement slot during termination.

11. The interconnection system of claim 8, wherein the IDC slot of a rearwardmost one of the legs of the terminal is dimensioned smaller than that of a forwardmost one of the legs, and the lower contact receiving passageway includes a tapered reduced diameter portion between the forwardmost and the rearwardmost legs permitting an end of a smaller diameter of a conductor to pass therebeyond and through the wire receiving opening of the rearwardmost leg to be urged into the IDC slot of the rearwardmost leg upon movement of the silo to the termination position.

12. The interconnection system of claim 1, wherein during termination of the assembly, the lower contact receiving passageway is aligned with the aligned IDC termination slots before the upper contact receiving passageway is aligned with the third IDC termination slot thereby staggering the forces needed for terminating a wire in the slot and lowering the required forces for termination.

13. The interconnection system of claim 1, wherein a cover is recieved along the bottom of the base, the cover having latching fingers which engage the base to secure the cover thereto and protect the interior of the base.

14. The interconnection system of claim 1, wherein a ground contact is secured to the base member, the ground contact having a mounting tab for securing the assembly within an enclosure.

15. The interconnection system of claim 14, wherein the ground contact has contact fingers for engaging the grounding region on an overvoltage protector.

16. An interconnection system, comprising:

an assembly having a base member and a silo, the silo having an upper contact receiving passageway and a lower contact receiving passageway, the silo being slidably mounted onto the base and reciprocally movable in a linear manner between an unterminated position and a terminated position;

a pair of U-shaped terminals, each of the terminals being securable in the base to be received within the silo upon assembly of the silo to the base, each of the terminals including a base section and a pair of legs extending normally therefrom to define the U-shape, the legs including aligned wire receiving openings and aligned IDC termination slots extending from the openings, a third IDC termination slot is formed along a top of each terminal; and, a latching system for securing the silo to the base, the latching system comprising an opening on the silo with a resilient finger therein, the latching system further comprising two latching protrusions on the base, when the silo is in the unterminated position, the upper of the two latching protrusions is received within the opening on the silo thereby securing the silo in the unterminated position, when the silo is in the terminated position, the upper of the two latching protrusions engages the resilient finger and the lower of the two latching protrusions is received within the opening thereby securing the silo in the terminated position.

17. The interconnection system of claim 16, wherein the base member includes a pedestal having a pair of spaced apart retention slots for receiving and securing the terminals therein.

18. The interconnection system of claim 17, wherein the pedestal has latching ledges and the terminals have latching windows, the latching ledges being received within the latching windows to secure the terminals to the base.

19. The interconnection system of claim 16, wherein each terminal has a lower end with a contact section for termination with a surge protector.

20. The interconnection system of claim 16, wherein each terminal has a lower end with a contact section for termination with a bridging contact.

21. The interconnection system of claim 16, wherein the assembly has tool engaging surfaces whereby the application of a tool can effect movement of the silo between the unterminated position and the termination position.

22. The interconnection system of claim 16, wherein each terminal has a split beam latch to secure the terminal within the base, the latch having two latching arms with protrusions on ends thereof, the latching arms engaging a portion of the base to secure the terminals to the base.

23. The interconnection system of claim 16, wherein the terminals of each pair are arranged in close proximity to one another within the silo, with respective ones of the legs of the terminals being planarly aligned and orthogonal to the contact receiving passageways.

24. The interconnection system of claim 23, wherein a wall of the leg, adjacent the insulation displacement slot, includes a pair of windows to allow flexing of the insulation displacement slot during termination.

25. The interconnection system of claim 24, wherein the IDC slot of a rearwardmost one of the legs of each terminal is dimensioned smaller than that of a forwardmost one of the legs, and the lower contact receiving passageway includes a tapered reduced diameter portion between the forwardmost and the rearwardmost legs permitting an end of a smaller diameter of a conductor to pass therebeyond and through the wire receiving opening of the rearwardmost leg to be urged into the IDC slot of the rearwardmost leg upon movement of the silo to the termination position.

26. The interconnection system of claim 16, wherein the third IDC termination slot comprises a pair of legs extending upwardly from the terminal with the IDC slot disposed therebetween.

27. The interconnection system of claim 16, wherein during termination of the assembly, the lower contact receiving passageway is aligned with the aligned IDC termination slots before the upper contact receiving passageway is aligned with the third IDC termination slot thereby staggering the forces needed for terminating a wire in the slot and lowering the required forces for termination.

28. The interconnection system of claim 16, wherein a cover is recieved along the bottom of the base, the cover having latching fingers which engage the base to secure the cover thereto and protect the interior of the base.

29. The interconnection system of claim 16, wherein a ground contact is secured to the base member, the ground contact having a mounting tab for securing the assembly within an enclosure.

30. The interconnection system of claim 29, wherein the ground contact has contact fingers for engaging the grounding region on an overvoltage protector.

31. An interconnection system, comprising:

an assembly having a base member and a silo, the silo having an upper contact receiving passageway and a lower contact receiving passageway, the silo being slidably mounted onto the base and reciprocally movable in a linear manner between an unterminated position and a terminated position;

a pair of U-shaped terminals, each of the terminals being securable in the base to be received within the silo upon assembly of the silo to the base, each of the terminals including a base section and a pair of legs extending normally therefrom to define the U-shape, the legs including aligned wire receiving openings and aligned IDC termination slots extending from the openings, a third IDC termination slot is formed along a top of each terminal;

the lower passageway of the silo being aligned with the wire receiving openings and the upper passageway being above the third IDC termination slot when the silo is in the unterminated position, the lower passageway of the silo being aligned with the aligned IDC termination slots and the upper passageway being aligned with the third IDC termination slot when the silo is in the terminated position.

32. The interconnection system of claim 31, wherein the base member includes a pedestal having a pair of spaced apart retention slots for receiving and securing the terminals therein.

33. The interconnection system of claim 32, wherein the pedestal has latching ledges and the terminals have latching windows, the latching ledges being received within the latching windows to secure the terminals to the base.

34. The interconnection system of claim 31, wherein each terminal has a lower end with a contact section for termination with a surge protector.

35. The interconnection system of claim 31, wherein each terminal has a lower end with a contact section for termination with a bridging contact.

36. The interconnection system of claim 31, wherein the assembly has tool engaging surfaces whereby the application of a tool can effect movement of the silo between the unterminated position and the termination position.

37. The interconnection system of claim 31, wherein each terminal has a split beam latch to secure the terminals within the base, the latch having two latching arms with protrusions on ends thereof, the latching arms engaging a portion of the base to secure the terminal to the base.

38. The interconnection system of claim 32, wherein the assembly has a latching system for securing the silo to the base, the latching system comprising an opening on the silo with a resilient finger therein, the latching system further comprising two latching protrusions on the base, when the silo is in the unterminated position, the upper of the two latching protrusions is received within the opening on the silo thereby securing the silo in the unterminated position, when the silo is in the terminated position, the upper of the two latching protrusions engages the resilient finger and the lower of the two latching protrusions is received within the opening thereby securing the silo in the terminated position.

39. The interconnection system of claim 31, wherein the terminals of each pair are arranged in close proximity to one another within the silo, with respective ones of the legs of the terminals being planarly aligned and orthogonal to the contact receiving passageways.

40. The interconnection system of claim 39, wherein a wall of the leg, adjacent the insulation displacement slot, includes a pair of windows to allow flexing of the insulation displacement slot during termination.

41. The interconnection system of claim 31, wherein the third IDC termination slot comprises a pair of legs extending upwardly from each terminal with the IDC slot disposed therebetween.

42. The interconnection system of claim 31, wherein a cover is recieved along the bottom of the base, the cover having latching fingers which engage the base to secure the cover thereto and protect the interior of the base.

43. The interconnection system of claim 31, wherein a ground contact is secured to the base member, the ground contact having a mounting tab for securing the assembly within an enclosure.

44. The interconnection system of claim 43, wherein the ground contact has contact fingers for engaging the grounding region on an overvoltage protector.

45. An interconnection system having a base, at least one IDC terminal mounted to the base and a silo being slidably mounted to the base over the terminal and having upper and lower passageways to effect termination of wires inserted into the passageways to the IDC terminal, the IDC terminal comprising:

a front leg having a first wire receiving opening being aligned with one of the passageways when the silo is in an unterminated position and a first IDC slot extending from the wire receiving opening;

a rear leg having a second wire receiving opening and a second IDC slot extending therefrom each being aligned with the first wire receiving opening and first IDC slot respectively, the second IDC slot being dimensioned to be larger than the first IDC slot; and, a base leg joining the front and rear legs to define a U-shape.

46. The interconnection system of claim 45, wherein the terminal has a lower end with a contact section for termination with a surge protector.

47. The interconnection system of claim 45, wherein the terminal has a lower end with a contact section for termination with a bridging contact.

48. The interconnection system of claim 45, wherein the terminal has a split beam latch to secure the terminal within a retention slot of the base, the latch having two latching arms with protrusions on ends thereof, the latching arms engaging a portion of the base to secure the terminal to the base.

49. The interconnection system of claim 45, wherein the terminal further comprises a third IDC termination slot extending from a top, the third slot having a pair of legs extending upwardly from the terminal such that the IDC slot is disposed therebetween.

* * * * *